United States Patent [19]

Jourdan

[11] 4,424,635

[45] Jan. 10, 1984

[54] SHOE HEEL STRUCTURE FOR A WOMAN'S SHOE

[75] Inventor: Henri R. Jourdan, Romans, France

[73] Assignee: Polyplastiform, France

[21] Appl. No.: 302,743

[22] Filed: Sep. 16, 1981

[30] Foreign Application Priority Data

Jun. 19, 1981 [FR] France ..... 81 12146

[51] Int. Cl.[3] ..... A43B 21/20; A43B 21/36

[52] U.S. Cl. ..... 36/34 A; 36/36 R; 36/42

[58] Field of Search ..... 36/34 R, 34 A, 36 R, 36/42; 12/147 R, 147 A

[56] References Cited

U.S. PATENT DOCUMENTS

| | | | |
|---|---|---|---|
| 1,947,840 | 2/1934 | Fitzsimmons | 36/42 |
| 2,111,314 | 3/1938 | Critchley | 36/42 |
| 2,875,532 | 3/1959 | Fitzsimmons | 36/34 R |
| 3,063,170 | 11/1962 | Purtell | 36/42 |
| 3,119,192 | 1/1964 | Ronci | 36/34 A |
| 3,152,408 | 10/1964 | Thiessen | 36/36 R |
| 3,218,736 | 11/1965 | Sahagun | 36/34 R |

FOREIGN PATENT DOCUMENTS

| | | | |
|---|---|---|---|
| 740043 | 11/1932 | France . | |
| 815336 | 4/1937 | France . | |
| 1235297 | 5/1960 | France . | |
| 1268598 | 6/1961 | France | 36/34 A |
| 2412281 | 7/1979 | France . | |
| 879761 | 10/1911 | United Kingdom | 36/34 A |

*Primary Examiner*—James Kee Chi

*Attorney, Agent, or Firm*—Roylance, Abrams, Berdo & Goodman

[57] ABSTRACT

A shoe heel, particularly for a woman's shoe, has a body with a small cross-sectional end area and a wear piece or heelpiece of an abrasion-resistant material. The body and wear piece are connected by a pair of telescoping tubes having non-circular cross-sectional shapes, one of which is embedded in the body during molding thereof, and the lower end of the other is embedded in the wear piece. The tubes have aligned slots with material exposed to increase the frictional engagement for holding them together.

1 Claim, 6 Drawing Figures

F
V
V

SHOE HEEL STRUCTURE FOR A WOMAN'S SHOE

The invention relates to a shoe heel, particularly for lady shoes, consisting of a body the bottom part of which has a relatively small cross-sectional area and from which extends a wear piece or heel-piece made of an abrasion-resistant material, whereby connecting means between said body and wear piece allow the latter to be easily replaced.

The drawbacks of heretofore known heels of this kind are well known.

The heel body, particularly in the case of so-called "Louis heels", is brittle. The wear piece, when it is made of a metal so as to withstand abrasion, is highly loud-sounding and slippery and damages floors and carpet weft. When the wear piece is made of a plastic material, even having a great abrasion resistance, it becomes distorted or torn-out and rapidly worn out, and it is difficult to replace it. Finally, the connection between the body and wear piece does not withstand bending or tearing. Replacement of the wear piece is uneasy and results in damages to the heel body.

The purpose of the invention is to overcome the above drawbacks by providing a heel of the above described type which is characterized in that the connecting means consist of a tube having a non-circular cross-sectional shape, advantageously a half-round cross-sectional shape, which is embedded into the body upon molding thereof and the bottom surface of which is flush with the bottom surface of the body, and a pin the lower end of which is embedded in the wear piece and the free end of which, having the same outer cross-sectional area as the inner cross-sectional area of the tube, is accomodated in the tube. Preferably, the tube is provided with a longitudinally extending slot which upon molding, becomes filled with body material due to a slight inward creepage thereof.

It should be realized that in this way the strength of the body itself is increased by the embedded tube which is in turn stiffened by the pin accomodated in the tube.

The wear piece can be easily replaced by simply withdrawing the pin to make room for a new wear piece. In addition, the hold of the pin in the tube is improved by the material which is flush with the extent of the longitudinal slot and rubs against the pin.

In a preferred embodiment of the invention, the pin likewise consists of a tube which, upon molding of the wear piece, becomes filled with a portion of the molding material, and which may also be provided with a longitudinally extending slot which, upon molding, becomes filled due to a slight outward creepage of the material filling the tube. Of course, the two slots can be positioned opposite each other.

The tubular shape of the pin highly improves its strength and its cohesion with the wear piece due to the material with which it becomes filled during the molding operation. This material, by flowing or creeping through the pin slot, improves, under the same conditions as hereinabove, the pin hold in the tube, particularly if both slots are opposite each other, whereby there is a rubbing action between the body material and the wear piece material.

In a further improved embodiment of the invention, the pin is provided with a ratchet wheel embedded in the wear piece. The ratchet wheel improves the anchorage of the pin in the wear piece and can also, if the heel becomes worn out, increase the abrasion resistance of the wear piece without however damaging floors or carpets.

An embodiment of the invention will now be described hereinafter as a non-limiting example with reference to the accompanying drawings, in which.

Figures 1, 2, 3, 4, 5, 6:
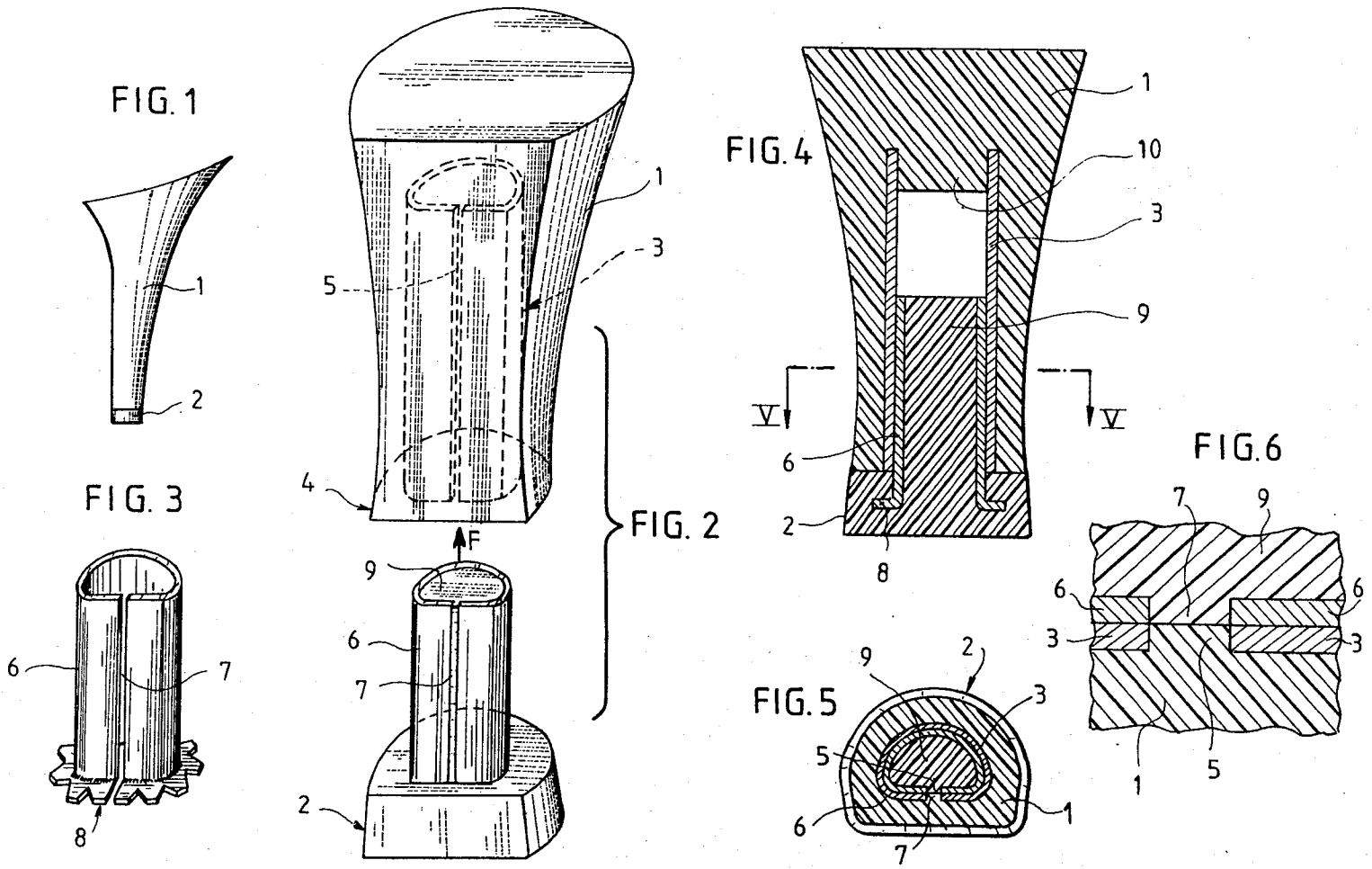
FIG. 1 is a small-scale side view of a heel in accordance with the invention.
FIG. 2 is a partial view, in exploded perspective, of the heel shown in FIG. 1.
FIG. 3 shows the tubular pin as used.
FIG. 4 is a longitudinal cross-sectional view of the lower part of the heel.
FIG. 5 is a cross-sectional view taken along line 5—5 of FIG. 4.
FIG. 6 is a partial cross-sectional view, on an enlarged scale, taken along the tube and pin slots.

As shown in FIG. 1, the heel consists, in a well-known manner, of a body 1 the upper part of which is shaped so as to match with the shoe, and the bottom of which has a quite small cross-sectional area, as it is the case for so-called "Louis heels". From the body extends a wear piece or heel-piece 2 which is secured to the body bottom and forms the removable wear piece thereof.

As shown in FIG. 2, in the molding operation a metal tube 3 which is flush with the bottom surface 4 of the body and the length of which is about as shown in the drawing or may be somewhat greater, has been embedded into the body 1. Said tube has a semi-circular cross-sectional shape and its planar face is provided with a longitudinally extending slot 5 the width of which should be about 1 or 2 millimeters. From the wear piece itself 2, which is of conventional shape in its lower part, extends a pin 6 the lower end of which is embedded in the wear piece. The outer cross-section of said pin is exactly identical to the inner cross-section of tube 3. Its planar face is also provided with a longitudinally extending slot 7 the width of which may be the same as the width of slot 5.

As best shown in FIG. 3, the pin is provided at its bottom part with a ratched wheel 8 which is embedded in the wear piece in the molding operation.

As also shown in FIG. 2, in the molding process the material of wear piece 2 has propelled itself at 9 into the tubular pin 6 until the latter becomes completely filled therewith.

In FIGS. 4 and 5, it can be seen how the material-filled pin 6 engages into tube 3, the upper part of which may likewise contain in turn, at 10, some amount of the body material which has entered thereinto through the upper opening in tube 3.

In FIG. 4, it can also be seen that ratched wheel 8, which is embedded in the heel at about mid-height, provides an excellent cohesion between the wear piece and the pin and when the wear piece becomes worn out, the substantially planar bottom surface of the ratchet wheel can improve abrasion resistance of the wear piece.

As shown particularly in FIG. 5, both slots 5 and 7 of tube 3 and pin 6, respectively, are disposed opposite each other, and the advantages of such a disposition have been illustrated on an enlarged scale in FIG. 6.

As shown in FIG. 6, the body material 1 has crept inwardly through slot 5 of tube 3, while material 9 of the wear piece has crept outwardly through slot 7 of pin 6.

The body and wear piece materials thus oppositely contact each other since creepage results in a slight swelling or bulge. There has thus been generated in this area and along the entire length of the pin a substantial force which provides an excellent hold of the wear piece.

The other advantages of the invention will be readily apparent from the drawings.

As shown in FIG. 2, the assembly of a new wear piece can be carried out in a very simple manner by moving the wear piece in the direction of arrow F by means of a few hammer blows after the old worn-out wear piece has been withdrawn by means of tongs.

The positioning is extremely accurate due to the precision which can be achieved in the molding operation by conventional methods and due to the half-round shapes of the tube and pin. Strength of the body itself is provided by the reinforcement resulting from the provision of the tube which is in turn stiffened by the pin.

I claim:

1. A shoe heel particularly for a woman's shoe, the heel being of the type having a molded body with a distal end of small cross-sectional area, a molded replaceable wear piece made of an abrasion resistant material and means for coupling the wear piece to the body, the improvement wherein said means for coupling comprises a first tubular member of non-circular cross section molded into said body, said first member having a longitudinal slot filled with the material from which said body is molded, said first member being substantially hollow and having an end open at the distal end of said heel; and a second tubular member of non-circular cross section fixedly attached at one end to said wear piece, said second member being shaped and dimensioned to be tightly telescopically received in said first member so that said wear piece abuts said distal end of said body, said second member having a longitudinal slot aligned with said slot in said first member, said second member and said slot being filled with molding material such that the material filling said first and second slots is in contact when said second member is received in said first member, thereby increasing the frictional engagement between said members to inhibit separation thereof.

* * * * *